US005556236A

United States Patent [19]

Seim, II et al.

[11] Patent Number: 5,556,236

[45] Date of Patent: Sep. 17, 1996

[54] CONVEYOR SYSTEM FOR ROD-LIKE ARTICLES

[75] Inventors: Albert D. Seim, II; Herman J. Steinbuchel; Charles R. Willing, all of Richmond, Va.

[73] Assignee: Molins PLC, Milton Keynes, United Kingdom

[21] Appl. No.: 473,939

[22] Filed: Jun. 7, 1995

Related U.S. Application Data

[63] Continuation of Ser. No. 149,934, Nov. 10, 1993, abandoned.

[30] Foreign Application Priority Data

Nov. 11, 1992 [GB] United Kingdom ..... 9223612

[51] Int. Cl.[6] ..... B65G 51/02

[52] U.S. Cl. ..... 406/3; 406/11; 406/28; 406/155; 406/182; 406/191; 131/95; 131/282

[58] Field of Search ..... 406/191, 1, 2, 406/3, 4, 5, 6, 7, 8, 9, 10, 11, 28, 29, 31, 154, 155, 156, 176, 177, 178, 179, 180, 181, 182, 183; 131/95, 282, 283

[56] References Cited

U.S. PATENT DOCUMENTS

| | | | |
|---|---|---|---|
| 923,281 | 6/1909 | Litchfield | 406/180 |
| 968,577 | 8/1910 | Litchfield | 406/9 |
| 2,644,722 | 7/1953 | Childress | 406/183 X |
| 3,082,974 | 3/1963 | Halpern | 406/3 |
| 3,318,327 | 5/1967 | Himes et al. | 406/192 X |
| 3,868,071 | 2/1975 | Weaver | 406/182 |

*Primary Examiner*—Andrew C. Pike

*Attorney, Agent, or Firm*—Antonelli, Terry, Stout & Kraus

[57] ABSTRACT

A pneumatic filter transport system has a gate (18) in a section of conveying duct (2), which gate and is openable in response to signals indicating a filter rod jam in a receiver unit (15) connected to the duct. Once opened, the gate allows remaining filters in the duct to be directed to a dump (30): this reduces the risk of a receiver jam developing into a line jam (which is more difficult to clear). The gate may be provided in a curved section of duct just upstream of the receiver. The duct may incorporate a longitudinally-extending partition (60), which allows removal from the duct of loose material (e.g., carbon granules) which has become separated from the conveyed filters. The duct may have longitudinal slots (68) which allow conveying air to exhaust from the duct upstream of the receiver.

17 Claims, 4 Drawing Sheets

CONVEYOR SYSTEM FOR ROD-LIKE ARTICLES

Figure 2:
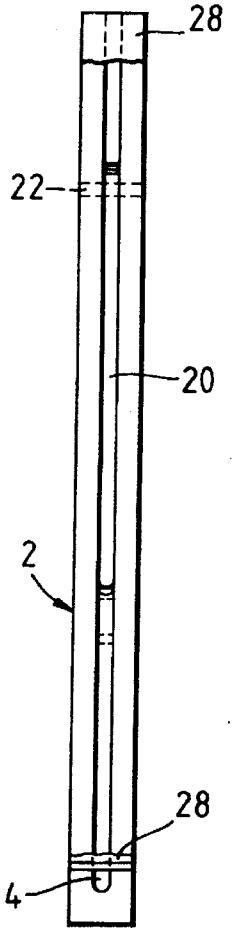

This application is a Continuation of application Ser. No. 08/149,934, filed Nov. 10, 1993, now abandoned.

This invention relates to a conveyor system for rod-like articles, particularly a pneumatic conveying system for such articles.

Pneumatic conveying systems in which rod-like articles are conveyed axially in line through a conduit from a distributing unit to a receiver unit by means of pressure air are well known in the tobacco industry and are commonly used for conveying filter rod lengths from a filter rod making machine to one or more filter cigarette assembling machines, in which the filter rods are attached to tobacco lengths to produce filter cigarettes. Examples of such systems are disclosed in British patent specifications Nos. 1561560 and 2059901.

In such pneumatic conveying systems blockages or jams do sometimes occur, particularly in the region of the receiver unit, and this can cause damage to individual filters, particularly where these are of fragile construction. It is important that damaged filter rods should not enter the filter cigarette assembling machine since at best this is likely to cause wastage of materials and at worst a stoppage or even damage to the machine itself.

According to one aspect of the present invention a conveyor system for rod-like articles comprises means defining a path for filter rods along which the rods are conveyed pneumatically between a distributor unit and a receiver unit, means defining a discontinuity in said path, preferably in the region of said receiver unit, gate means displaceable between a first position in which it bridges said discontinuity so that filter rods are conveyed along said path across said discontinuity and a second position in which filter rods exit said path at said discontinuity, and means for moving said gate means between said first and second positions.

Preferably the moving means includes actuating means responsive to signals derived from passage or occupation of filter rods along the path. Such signals may be derived from the receiver unit and indicate when a blockage or jam of filter rods has occurred, thereby causing the moving means to displace the gate means into its second position.

In a preferred construction the discontinuity is arranged in an outer peripheral portion of a curved path, typically at that part of the path (commonly known as the "short radius bend") which is located between a vertical (or inclined) transport pipe descending from an overhead section of pipe and a horizontal entry to the receiver unit. Where the discontinuity is in a curved portion of the path the gate means preferably includes means defining a similarly curved path portion for bridging the discontinuity.

Where filter rods containing carbon granules or other particulate filtering materials are conveyed through a pneumatic transport system, inevitably some of the material becomes separated from the rods and is subsequently conveyed loose through the system. It is undesirable that such material should reach the receiver unit where it can eventually interfere with operation of the unit and/or contaminate the surfaces of the filter rods.

According to another aspect of the invention a conveyor system for rod-like articles, particularly for filter rods containing particulate filter material, includes a pneumatic transport duct having a first longitudinally-extending region for conveying rods, a second longitudinally-extending region for collecting material which has become separated from the rods, transverse path means allowing said material to pass from said first to said second region, and means for removing said material from said second region.

In a preferred arrangement the duct comprises an internal guide separating said regions such that the filter rods are constrained to remain in the first region thus allowing particulate material to pass the guide to collect in the second region. Preferably the duct may be arranged such that particulate material is encouraged to migrate to the second region. Thus, the duct may be curved, with the second region being radially outer of the first region whereby material passes from the first to the second region at least partly under the influence of so-called centrifugal force. The collecting means may comprise an exhaust aperture for conveying air in a wall of the duct. Conveniently the duct is located immediately upstream of the receiver unit.

More generally, it may be desirable to provide means for exhausting most of the conveying air upstream of the receiver in any filter rod pneumatic conveying system. This can be achieved by providing a slot along a section of conveying duct upstream of the receiver, e.g., at the "short radius bend".

All aspects of the invention may be embodied in the same apparatus.

Figure 1:
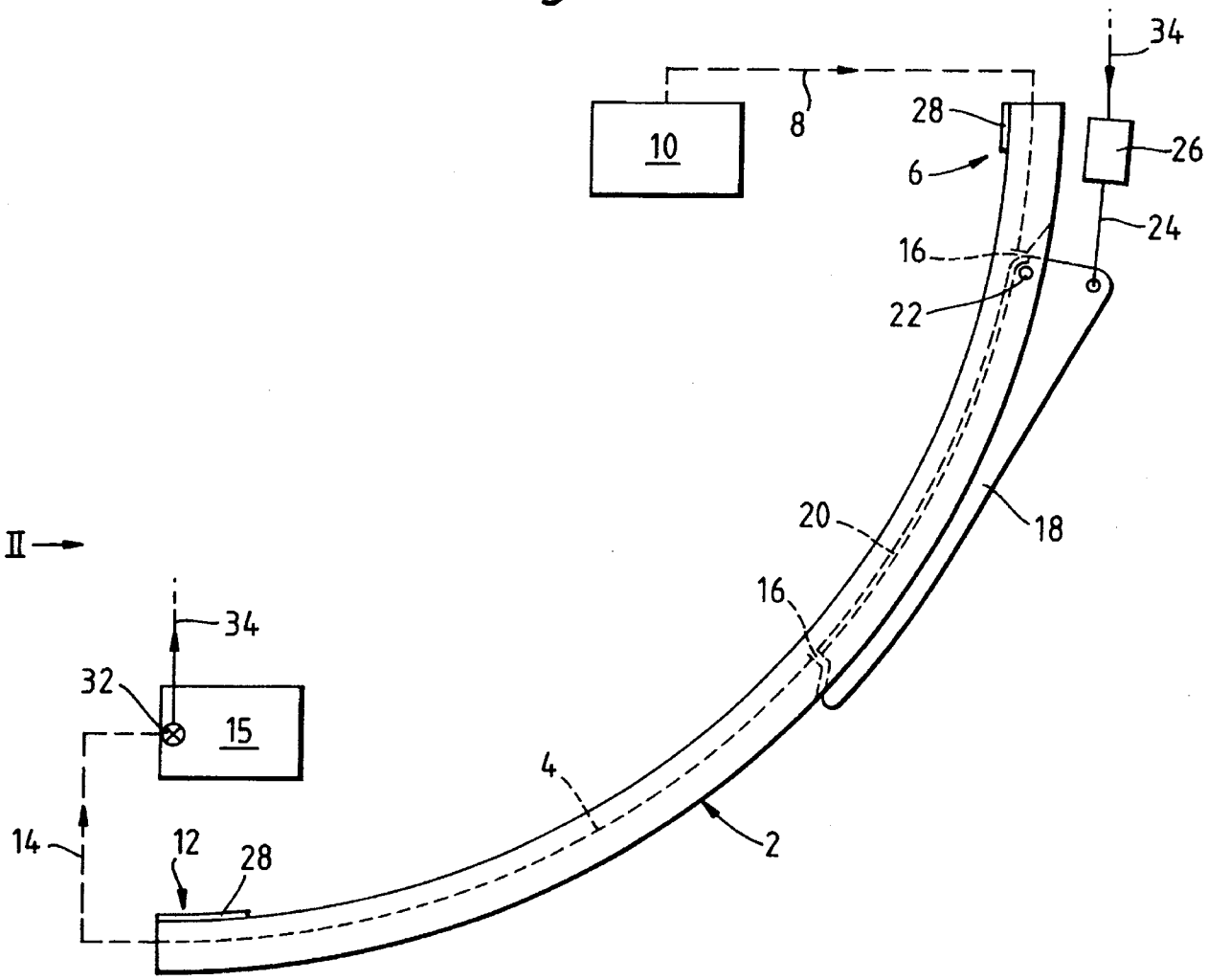
Figure 4:
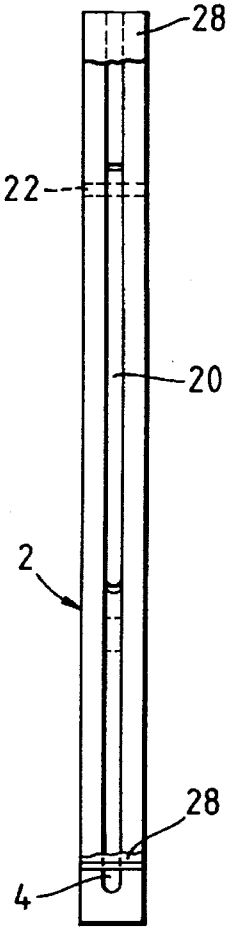
Figure 3:
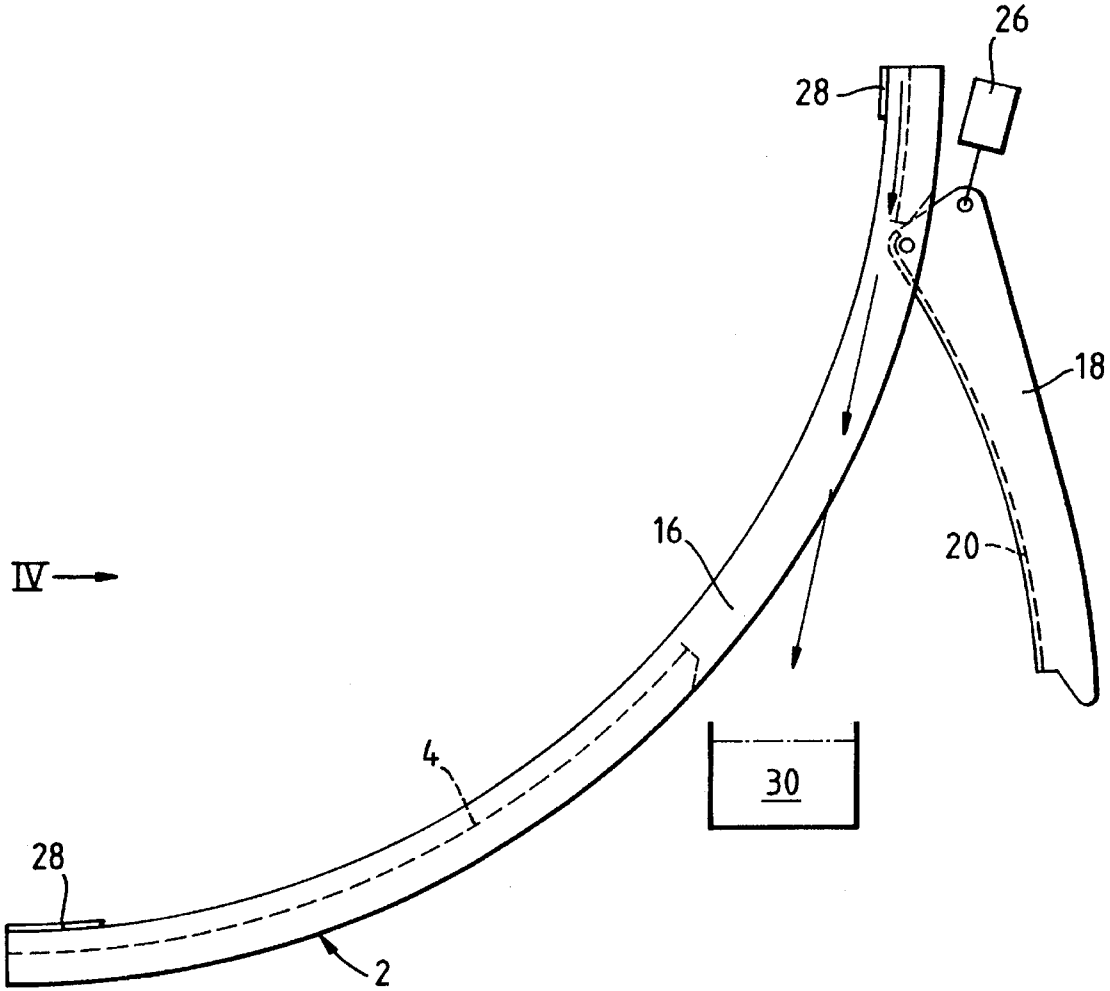
Figure 5:
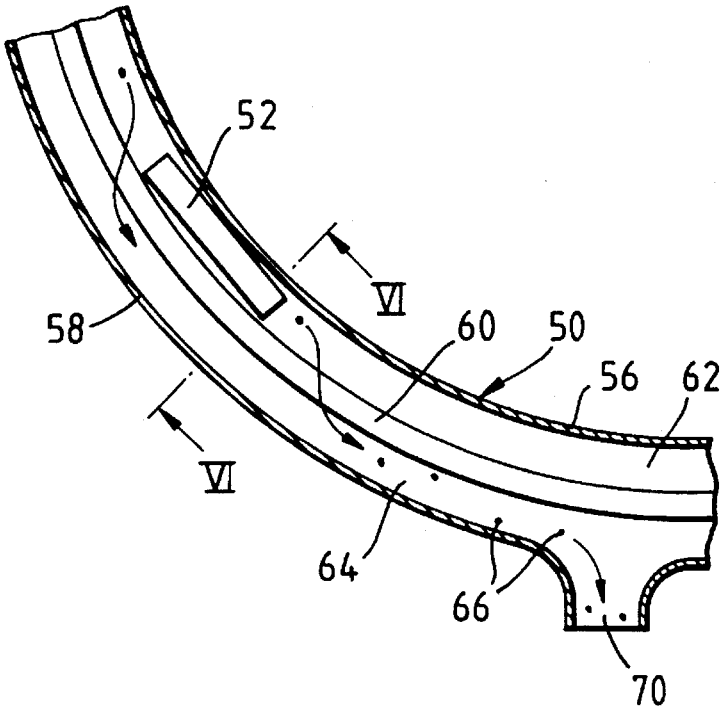
Figure 6:
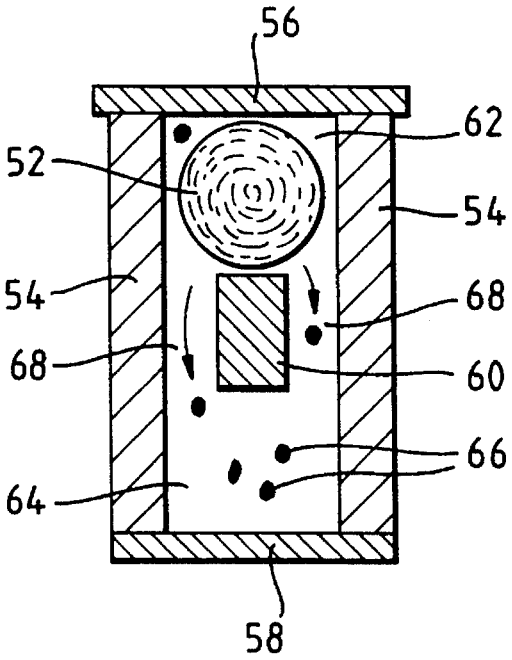
Figure 7:
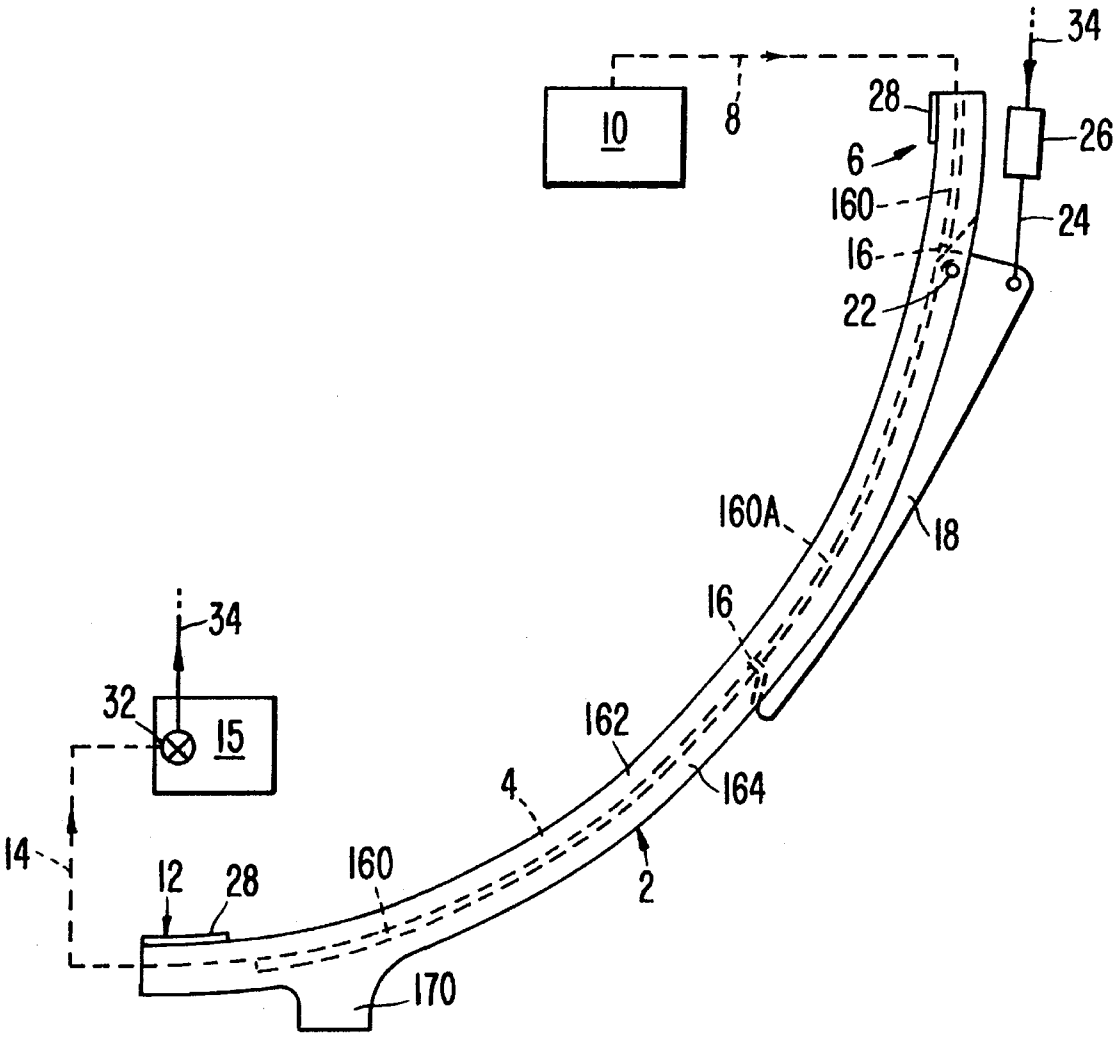

The invention will be further described, by way of example only, with reference to the accompanying diagrammatic drawings, in which:

FIG. 1 is a side view of a pneumatic conveying system for filter rods, with part of the system in a first operative condition, FIG. 2 is a view in the direction of arrow II in FIG. 1, FIG. 3 is a side view of the part of the system shown in FIG. 1 in a different operative condition, FIG. 4 is a view in the direction of arrow IV in FIG. 3, FIG. 5 is a partial-sectional side view of part of another pneumatic conveying system for filter rods, FIG. 6 is a transverse section on the line V1—V1 in FIG. 5, and FIG. 7 is a side view of a further pneumatic conveying system for filter rods.

FIGS. 1 and 2 show a curved guide member 2 defining an internal curved channel 4 for cigarette filter rods. The channel 4 is enclosed by a curved cover plate 28 (part of which only is shown in FIG. 1) extending along the inner periphery of the member 2. At its upstream end 6 the member 2 is connected to receive filter rods from a pneumatic transport pipe 8 extending from a pneumatic filter rod distributor unit 10, normally located adjacent a filter rod making machine (not shown). At its downstream end 12 the member 2 is connected by way of a path 14 to a receiver unit 15, normally located at a filter cigarette assembling machine (not shown). Thus the channel 4 forms part of a filter rod pneumatic conveying path 8, 4, and 14 extending from the distributor unit 10 to the receiver unit 15. The path 14 could comprise a further pneumatic transport pipe but more commonly the member 2 will be located substantially adjacent the receiver unit 15 so that filter rods may be discharged substantially directly from the channel 4 to the receiver unit.

The portion of member 2 which defines the lower portion of channel 4 has a discontinuity or gap 16 extending along part of its length. A displaceable gate member 18 is adapted to bridge this gap and has a curved guide channel 20 which, in the position of the gate member shown in FIGS. 1 and 2, lies substantially in alignment with the channel 4 so as providing a smooth path for filter rods through the entire length of the member 2. The gate member 18 is connected at its upstream end to the guide member 2 by means of a pivot 22 and is further attached to a piston rod 24 of an actuating cylinder 26.

Filter rods are conveyed pneumatically through the pipe 8. An airtight connection between the pipe 8 and the guide member 2 is provided at its upstream end 6 and, if necessary, at its downstream end 12 for connection to a conduit of path 14.

As shown in FIGS. 3 and 4, actuation of the cylinder 26 causes the gate member 18 to be pivoted from its position shown in FIGS. 1 and 2 to a position in which the gap 16 is no longer closed. As a consequence, conveying air (from the pipe 8) and conveyed filter rods exit the channel 4 through the gap 16, the filter rods being collected in a waste bin 30.

The gate member 18 is opened in response to a signal indicating a jam downstream of the guide member 2, usually in or adjacent the receiver unit 15. Thus, a detector 32 (FIG. 1) at the receiver unit 15 may signal the occurrence of a jam on a signal line 34, which line extends to the actuating cylinder 26 via control circuitry (not shown) so that the signal is effective to cause the gate member 18 to be opened. The gate member 18 could be operated by means other than the piston rod 24 and actuating cylinder 26. For example, a pneumatic or electric rotary actuator could be used.

Closure of the gate member 18 could be in response to a clearance signal generated at the detector 32. Alternatively, closure of the gate member 18 could be manual.

By preventing filter rods from backing up in the line (path 14 or in guide member 2) the risk of causing damage to filter rods and subsequently transferring damaged rods to the receiver unit 15 and thence to the filter assembling machine is avoided. In particular, the risk of a rod jam in or adjacent the receiver unit 15 (which is generally fairly easy to clear) developing into a rod jam in the pipe 8 (which is generally more difficult to clear) is reduced or eliminated.

The air supply from the distributor unit 10 may be maintained for at least a period after the gate member 18 is opened: in this way stationary filters are not left in the pipe 8. Alternatively, it would be possible to shut off the air supply immediately: this would minimize wastage of filters but would probably leave stationary filters in the pipe.

The detector 32 may typically comprise a fiber optic photocell unit linked via line 34 to circuitry including a processor loaded with software which expects to see a succession of filter rods and gaps as rods pass through the receiver unit 15: a jam is detected when the detector ceases to see such alternate rods and gaps. Instead of relying on software the circuit to which the detector 32 is connected could incorporate electrical timing means to provide detection of a jam.

The gate member 18 may be opened or closed while filter rods are stationary in or passing through the guide member 2 without damaging the rods or causing a jam in the receiver unit 15, guide member 2, or pipe 8.

FIGS. 5 and 6 show a curved guide member 50 for filter rods 52. The member 50 is located adjacent a receiver unit (not shown) in a system similar to that shown in FIG. 1. The member 50 has side plates 54 and top and bottom covers 56, 58. An internal filter guide 60 extends longitudinally between the top and bottom covers 56, 58 and effectively divides the inside of the member 50 into upper and lower chambers 62, 64. The filter rods 52 are conveyed in the upper chamber 62. Loose material 66 travelling with the conveying air and filter rods 52, particularly carbon granules or particles, tends to pass from the upper chamber 62 to the lower chamber 64 through passages 68 between the guide 60 and side walls 54. As can be seen in FIG. 6, the passages 68 are too narrow to allow a filter 52 to pass. The bottom cover 58 has an aperture 70 (FIG. 5) through which material collected in the chamber 64 and conveying air exit to a collection point (not shown). The member 50 could be provided with a movable gate (provided in the cover 58 and guide 60) similar to the gate 18 of FIG. 1 as will be described in this specification with reference to FIG. 7.

The arrangement of FIGS. 5 and 6 could be used for ordinary filters, in which case the cover 58 may be omitted and the depth of the walls 54 reduced so that their lower edges are approximately level with the lower edge of the guide 60. In this arrangement any gate similar to the gate 18 would be provided solely in the guide 60. Conveying air can exhaust between the guide 60 and side walls 54 upstream of the receiver unit.

FIG. 7 shows a system similar to that of FIG. 1 but incorporating in addition an internal filter guide 160. Parts similar to those in the system of FIG. 1 have been given similar reference numbers. As in the system of FIGS. 5 and 6, the guide 160 divides the chamber 4 into upper and lower chambers 162, 164, defined between the top cover 28 and the bottom of the curved guide member 2. The guide 160 includes a portion 160A which is displaceable with the gate member 18, as well as portions upstream and downstream of the gap 16. An exit aperture 170 is provided corresponding to the aperture 70 in FIG. 5.

We claim:

1. A conveyor system for rod-like articles comprising: a distributor unit, a receiver unit, means defining a path for said articles along which the articles are conveyed pneumatically from the distributor unit and into the receiver unit, means defining a discontinuity in said path, a gate displaceable between a first position in which said gate bridges said discontinuity so that the articles are conveyed along said path across said discontinuity and a second position in which the articles exit said path at said discontinuity, signal generating means downstream of said discontinuity for generating signals responsive to passage or occupation of said articles along said path downstream of said discontinuity and means for moving said gate between said first position and said second position, said moving means including actuating means responsive to said signals.

2. A conveyor system as claimed in claim 1, wherein said signal generating means includes means for generating said signals in a form which indicates when a blockage or jam of the articles has occurred, said moving means including means to displace the gate into said second position thereof in response to said signals.

3. A conveyor system as claimed in claim 2, wherein said discontinuity is arranged in a region of said signal generating means.

4. A conveyor system as claimed in claim 1, wherein the path defining means includes means defining a curved path, and said discontinuity is arranged in an outer peripheral portion of said curved path.

5. A conveyor system as claimed in claim 4, wherein the gate includes means defining a similarly curved path portion for bridging the discontinuity.

6. A conveyor system as claimed in claim 4, wherein said curved path extends between portions of said path which are respectively generally vertical and generally horizontal.

7. A conveyor system for filter rods containing particulate filter material comprising a pneumatic transport duct having a first longitudinally extending region for conveying the filter rods, a second longitudinally extending region for collecting the material which has become separated from the filter rods, transverse path means for allowing said material to pass from said first region to said second region, and means for removing said material from said second region.

8. A conveyor system as claimed in claim 7, wherein the duct comprises an internal guide separating said regions such that the filter rods are constrained to remain in the first region thus allowing the particulate material to pass the guide to collect in the second region.

9. A conveyor system as claimed in claim 7, wherein the duct is arranged such that the particulate material therein migrates to the second region.

10. A conveyor system as claimed in claim 9, wherein the duct is curved, with the second region being radially out ward of the first region.

11. A conveyor system as claimed in claim 7, wherein the removing means comprises an air exhaust aperture in a wall of the duct.

12. A conveyor system as claimed in claim 7, wherein the duct is located immediately upstream of a receiver unit.

13. A conveyor system for filter rods comprising a distribution unit; a receiver unit; means defining a pneumatic transport duct having a length, a first longitudinally extending region defining a path for the filter rods along which the filter rods are conveyed pneumatically from said distribution unit and into the receiver unit, a second longitudinally extending region for collecting material which has become separated from said filter rods, and transverse path means for allowing said material to pass from said first region to said second region, said first region of said pneumatic transport duct having a discontinuity along an outer portion of the length thereof; a gate displaceable between a first position in which said gate bridges said discontinuity so that the filter rods are conveyed along said path across said discontinuity and a second position in which the filter rods exit said path at said discontinuity; means for moving said gate between said first and second positions; and collecting means for removing the material from said second region.

14. A conveyor system as claimed in claim 13, wherein said pneumatic transport duct is curved, with said second region being radially outward of said first region.

15. A conveyor system as claimed in claim 14, wherein said gate includes means defining a path portion curved similarly to said duct for bridging said discontinuity.

16. A conveyor system as claimed in claim 15, wherein the collecting means comprises an air exhaust aperture in said pneumatic transport duct.

17. A conveyor system as claimed in claim 13, further including signal generating means downstream of said discontinuity for generating signals responsive to passage or occupation of said filter rods along said path downstream of said discontinuity, said moving means including actuating means responsive to said signals for moving said gate.

* * * * *